US005172556A

United States Patent [19]

Oike

[11] Patent Number: 5,172,556

[45] Date of Patent: Dec. 22, 1992

[54] AUTOMATIC ICE MAKER AND HOUSEHOLD REFRIGERATOR EQUIPPED THEREWITH

[75] Inventor: Hiroshi Oike, Osaka, Japan

[73] Assignee: Kabushiki Kaisha Toshiba, Kawasaki, Japan

[21] Appl. No.: 612,448

[22] Filed: Nov. 14, 1990

[30] Foreign Application Priority Data

Nov. 15, 1989 [JP] Japan ..... 1-296892

[51] Int. Cl.[5] ..... F25C 1/20

[52] U.S. Cl. ..... 62/68; 62/129; 62/353

[58] Field of Search ..... 62/68, 345, 353, 356, 62/71, 72, 129, 130

[56] References Cited

U.S. PATENT DOCUMENTS

| | | | |
|---|---|---|---|
| 507,005 | 10/1893 | Hill | 62/68 X |
| 1,296,741 | 3/1919 | Bester | 62/68 X |
| 3,224,213 | 12/1965 | Hoyt, Jr. | 62/68 |
| 3,318,105 | 5/1967 | Burroughs et al. | 62/71 |
| 3,451,227 | 6/1969 | Jacobs et al. | 62/68 X |
| 4,852,359 | 8/1989 | Mazzotti | 62/68 |
| 4,909,039 | 3/1990 | Yamada et al. | 62/129 X |

*Primary Examiner*—William E. Tapolcai

*Attorney, Agent, or Firm*—Cushman, Darby & Cushman

[57] ABSTRACT

An automatic ice maker includes an ice tray supplied with water, which water is made into ice. After the water in the ice tray is made into ice, the ice tray is inverted so that ice cubes are removed from the ice tray. During the ice making stage, a vibrator vibrates the ice tray so that the ice making at the water surface side in the ice tray is retarded, which causes air bubbles contained in the water in the ice tray to escape therefrom, thereby providing transparent ice cubes.

11 Claims, 5 Drawing Sheets

AUTOMATIC ICE MAKER AND HOUSEHOLD REFRIGERATOR EQUIPPED THEREWITH

BACKGROUND OF THE INVENTION

This invention relates to an automatic ice maker which automatically provides transparent ice cubes and a household refrigerator equipped therewith.

In automatic ice makers provided in household refrigerators, for example, water is supplied into an ice tray by water supply means and made into ice. After completion of such an ice making stage, the ice tray is rotatively moved by a drive mechanism so as to be inverted, thereby removing ice cubes from the ice tray and reserving them. Subsequently, water is re-supplied to the ice tray to be made into ice and such an ice making operation is reiteratively executed.

In the above-described ice making manner, the chilled air contacts every side of the ice tray containing the water nearly uniformly and accordingly, the water in the ice tray is frozen nearly uniformly over the whole. Consequently, air bubbles are often left in the ice cubes and render the ice cubes opaque. An ice maker which supplies transparent ice cubes have been desired.

SUMMARY OF THE INVENTION

Therefore, an object of the present invention is to provide an automatic ice maker which can provide transparent ice cubes and can attain the making of the transparent ice cubes with a simple construction and a household refrigerator equipped with the above-mentioned automatic ice maker.

The present invention provides an ice maker comprising an ice making compartment, an ice tray provided in the ice making compartment so as to be inverted, water supply means for supplying the ice tray with water, chilled air supply means for supplying chilled air to the interior of the ice making compartment so that the water in the ice tray is made into ice, vibration applying means for applying vibration to the ice tray during an ice making stage so that the ice making is retarded at the water surface side in the ice tray, thereby causing air bubbles contained in the water in the ice tray to escape therefrom, and a drive mechanism for driving the ice tray after the water in the ice tray is made into ice so that the ice tray is inverted, thereby removing the ice from the ice tray.

In accordance with the above-described ice maker, the ice tray is vibrated by the vibration applying means during the ice making stage such that air bubbles contained in the water in the ice tray is caused to promptly escape therefrom before the water surface side is frozen. Consequently, transparent ice may be made.

It is preferable that the ice tray have at least one rotational shaft supporting the ice tray slidably in the directions of the length of the rotational shaft and the vibration applying means apply vibration to the ice tray so that the ice tray is vibrated in the directions of the length of the rotational shaft thereof. This construction provides a structure of the ice tray easily vibrated, allowing it to be rotatively moved in the ice removing operation.

When an electromagnet is employed as a drive source for driving the vibration applying means, the cost of the drive source may be relatively reduced.

It is also preferable that the electromagnet have a plunger and an engaging portion formed in a distal end of the plunger, the ice tray have an engaged portion disengageably engaged with the engaging portion of the electromagnet, the engaging portion of the electromagnet engage the engaged portion of the ice tray while the ice tray is being re-inverted from an ice removing position to an ice making position, and the engaging portion of the electromagnet disengage from the engaged portion of the ice tray while the ice tray is being inverted from the ice making position to the ice removing position. Consequently, transmission of the vibration to the ice tray and inversion of the ice tray may be performed smoothly.

Alarming means may be provided for alarming in occurrence of an water supply failure. In this case, the alarming means alarms when the temperature sensed by the temperature sensor is lower than a predetermined temperature. Consequently, a user can find the water supply failure promptly.

Position detecting means may be provided for detecting both of horizontal and inversion positions of the ice tray to generate a signal when detecting each of the horizontal and inversion positions occupied by the ice tray. Based on the signals generated by the position detecting means, the drive mechanism may be controlled so that the ice tray is stopped at the horizontal and inversion positions. Consequently, the ice tray can be stopped exactly at these positions.

Furthermore, an ice reserving box may be provided for containing ice having fallen from the ice tray and reserved ice detecting means may be provided for detecting an amount of the ice reserved in the ice reserving box. In this case, the ice making operation may be interrupted while the reserved ice detecting means is determining that the ice reserving box is filled full with the ice. Consequently, an unnecessary amount of ice can be prevented from being made and ice can be prevented from overflowing the ice reserving box.

It is further preferable that the ice maker further comprise a heat insulation cover covering the upper side of the ice tray during the ice making operation so as to prevent the chilled air from contacting the water surface in the ice tray. As a result, the ice making at the water surface side may be retarded more reliably.

The ice maker may further comprise a heater applying heat to the upper side of the ice tray during the ice making stage. Preferably, the heater is disposed inside the cover covering the ice tray.

Furthermore, the ice maker may comprise a temperature sensor sensing the temperature of the ice tray and a microcomputer determining an ice making completion time to thereby control the drive mechanism and the vibration applying means. Since the ice making completion time is accurately determined by the microcomputer, transition from the ice making stage to the ice removing stage may be done timely.

Furthermore, when the above-described ice maker is incorporated in a household refrigerator, transparent ice cubes may be provided at home with ease.

In accordance with the present invention, a method of making ice comprises steps of supplying an ice tray with water, feeding chilled air into an ice making compartment so that the water in the ice tray disposed in the ice making compartment is frozen, vibrating the ice tray during an ice making operation so that air bubbles contained in the water in the ice tray is caused to promptly escape therefrom before the water surface side is frozen, and inverting the ice tray after ice is made, thereby removing the ice from the ice tray.

Other objects of the invention will become obvious upon an understanding of the illustrative embodiment about to be described. Various advantages not referred to herein will occur to one skilled in the art upon employment of the invention in practice.

DESCRIPTION OF THE PREFERRED EMBODIMENT

An embodiment of the present invention will be described with reference to the accompanying drawings.

Figure 2:
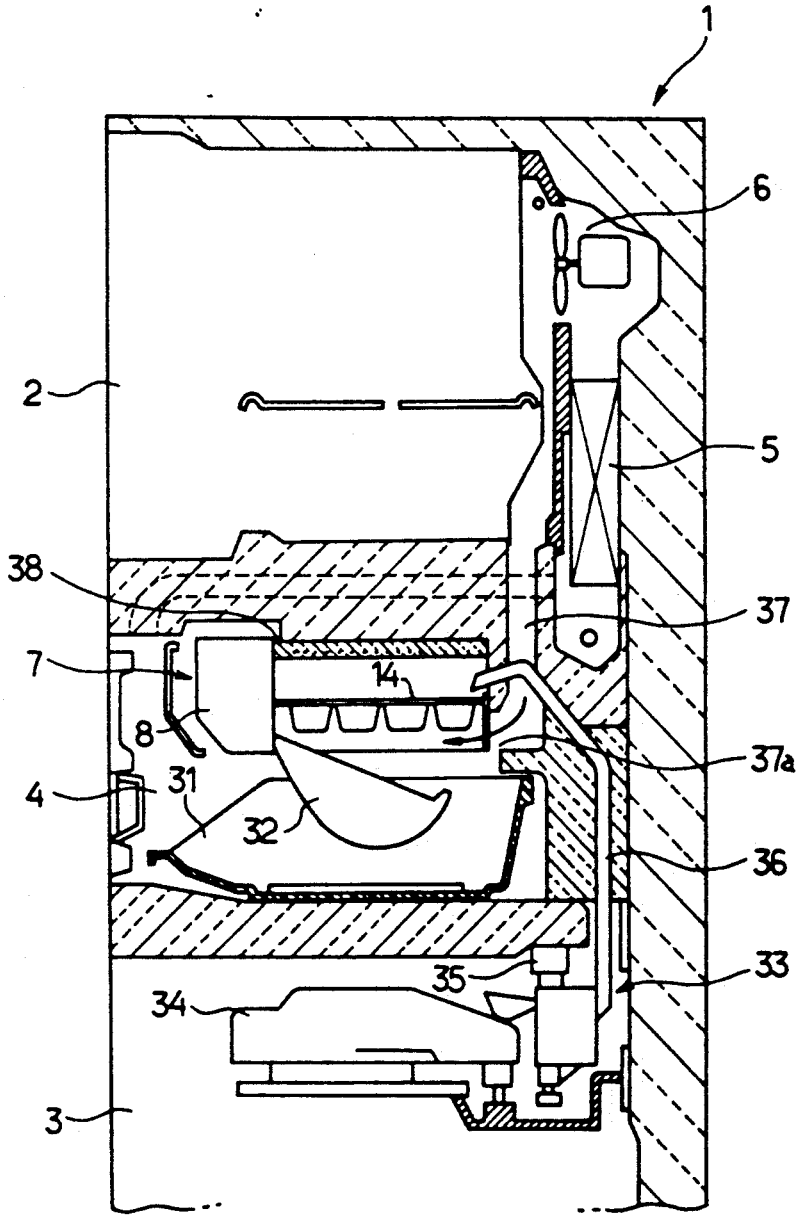
FIG. 2 is a partially longitudinal sectional side view of a refrigerator equipped with the ice maker.
Figure 3:
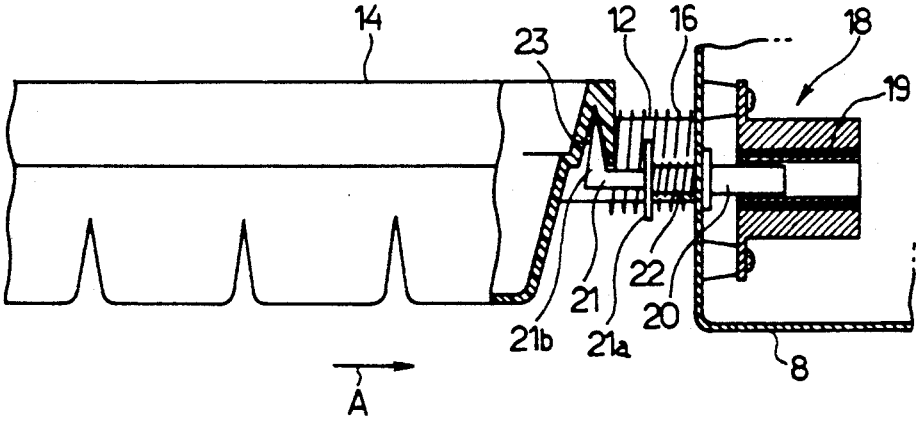
FIG. 3 is a longitudinal sectional side view of vibration applying means of the automatic ice maker.
Figure 4:
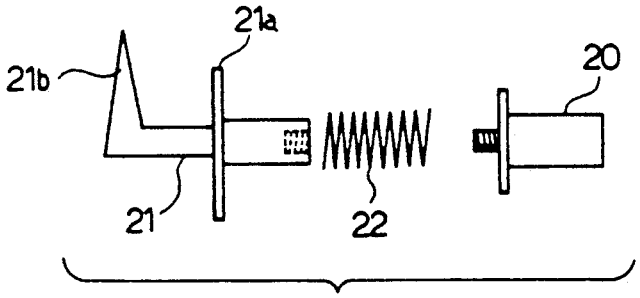
FIG. 4 is an exploded view of a vibration transmission mechanism of the ice maker.

Referring first to FIG. 2, a refrigerator cabinet 1 has therein a freezing compartment 2, a storage compartment 3 and an ice making compartment 4. Air chilled by an evaporator 5 is supplied to the compartments 2, 3, 4 by a fan 6. An automatic ice maker 7 in accordance with the present invention is provided in the ice making compartment 4. The automatic ice maker 7 will be described in detail below.

Figure 1:
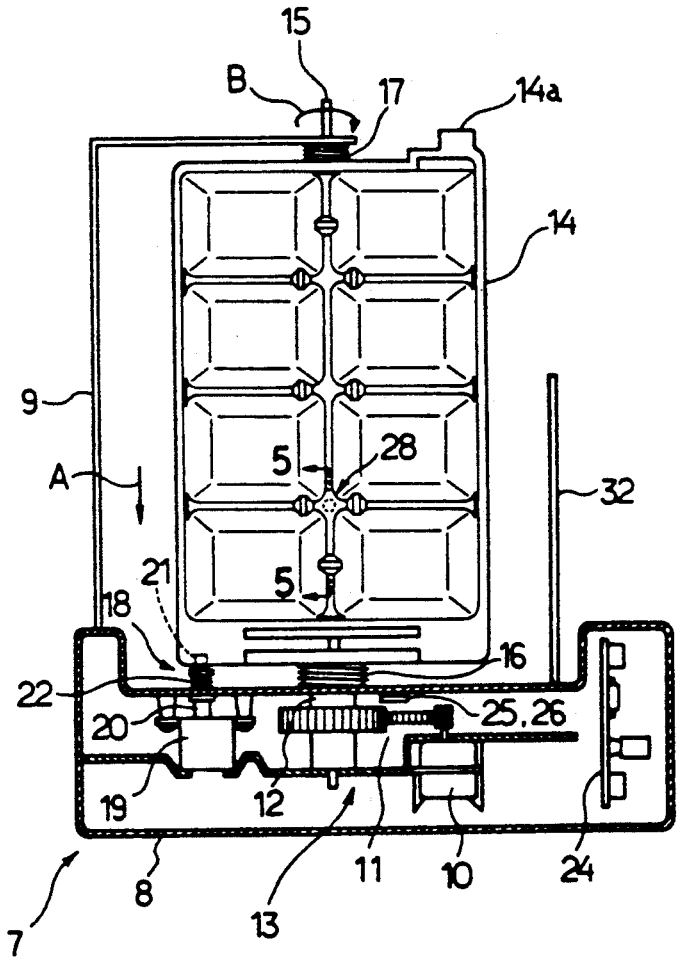
FIG. 1 is a transverse sectional view of an automatic ice maker in one embodiment of the present invention.

A generally rectangular box-shaped frame 8 is provided in the upper front interior of the ice making compartment 4. A generally L-shaped support member 9 is provided on an end of the rear of the frame 8 so as to extend rearwardly, as is shown in FIG. 1. A drive mechanism 13 comprising an electric motor 10, a reduction gear mechanism 11 and an output shaft 12 is provided in the frame 8. Rotation of the electric motor 10 is suitably reduced by the reduction gear mechanism 11 and then, transmitted to the output shaft 12. An ice tray 14 is formed of a plastic material, for example. The ice tray 14 has an upper opening and is formed into the shape of a thin rectangular box. The interior of the ice tray 14 is divided into a plurality of small compartments by partitions so that the corresponding number of ice cubes are provided. The ice tray 14 is supported by the output shaft 12 at the central front and by the support member 9 via a support shaft 15 at the central rear so that the ice tray 14 is moved in the directions of and rotatively moved about the shafts 12 and 15. The ice tray 14 is rotatively moved by the shaft 12. The output shaft 12 is provided with a compression coil spring 16 between the frame 8 and the ice tray 14 through the output shaft 12. The support shaft 15 is provided with another compression coil spring 17 between the ice tray 14 and the support member 9. The ice tray 14 has a convex portion 14*a* formed on an rear end thereof. The convex portion 14*a* is engaged with the support member 9 when the ice tray 14 is rotatively moved so as to be inverted, thereby limiting the rotative movement of the ice tray 14.

Reference numeral 18 designates a vibration applying mechanism as vibration applying means for vibrating the ice tray 14 so that it is moved in the directions of the shafts 12 and 15. The vibration applying mechanism 18 comprises an electromagnet 19 provided between the output shaft 12 and the support member 9 in the frame 8, a plunger 20 movably inserted in the electromagnet 19, a vibration transmission member 21 threadably engaged with an end of the plunger 20, and a compression coil spring 22 provided between a flange 21*a* of the vibration transmission member 21 and the rear wall of the frame 8. A distal engaging portion 21*b* of the vibration transmission member 21 is disengageably engaged, from below, with a generally V-shaped engaged portion 23 formed in the ice tray 14. Upon energization of the electromagnet 19, the plunger 20 is attracted against the compression coil spring 22 in the direction of an arrow A. With this movement of the plunger 20, the ice tray 14 is moved through the vibration transmission member 21 in the same direction as the plunger 20 is attracted. When the electromagnet 19 is deenergized, the compression coil spring 22 forces the plunger 20, the vibration transmission member 21 and the ice tray 14 to move together in the direction opposite the arrow A. These movements are reiteratively performed, thereby vibrating the ice tray 14 in the directions of the shafts 12 and 15.

Figure 5:
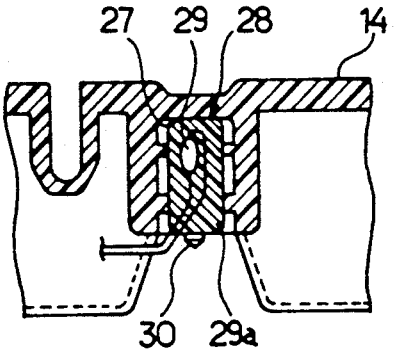
FIG. 5 is an enlarged longitudinal sectional view of a portion of the ice tray where a temperature sensor is mounted.
Figure 6:
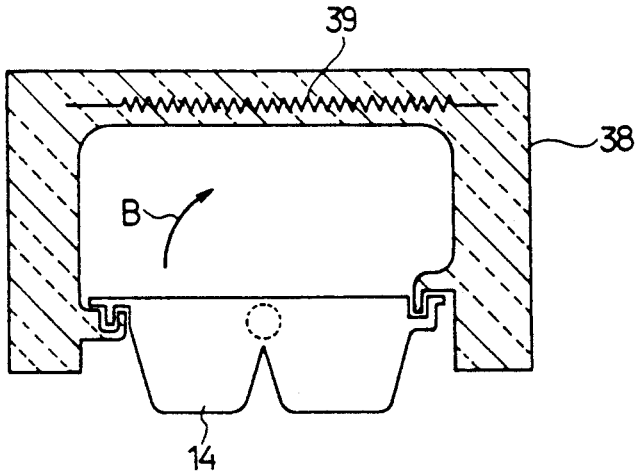
FIG. 6 is a longitudinal sectional view of a heat insulation cover.

In the frame 8 are provided a circuit board 24, a horizontal position detecting switch 25 provided in the vicinity of the output shaft 12 for detecting the horizontal position of the ice tray 14, and an inverted ice tray position detecting switch 26 for detecting the position of the ice tray 14 inverted. Each of these switches comprises, for example, a conventional proximity switch or photoelectric switch. An approximately circular recess 27 is formed in a predetermined portion of the ice tray 14, as shown in FIG. 5. The recess 27 has an open underside. Reference numeral 28 designates a cylindrical temperature sensor comprising a thermistor 29 molded out of a molding material 29*a*. The temperature sensor 28 is inserted in the recess 27 such that the thermistor 29 is positioned at the upper side, and secured by an engagement claw 30 formed on the ice tray 14. The temperature sensor 28 is provided for sensing the temperature of the upper side of the ice tray 14. Referring to FIG. 2, an ice reserving box 31 is drawably provided below the ice tray 14 in the ice making compartment 4. A reserved ice detecting lever 32 is rotatively mounted on the frame 8. Reference numeral 33 designates water supply means for supplying the ice tray 14 with water reserved in a water-supply tank 34 contained in the storage compartment 3 by way of a water-supply pump 35 through a water-supply pipe 36. A distal end of the water-supply pipe 36 faces the ice tray 14. An outlet 37*a* of a chilled air duct 37 supplying the chilled air to the ice making compartment 4 is directed to the underside of the ice tray 14 so that the chilled air is mainly caused to flow through the underside of the ice tray 14. Thus, chilled air supply means is composed of the chilled air duct 37, the evaporator 5 and the fan 6. A heat insulation cover 38 formed from a heat insulation material is provided in the ice making compartment 4 for covering the upper side of the ice tray 14. A heater 39 is provided on the upper portion of the heat insulation cover 38 as shown in FIG. 6. The heat insulation cover 38 is constructed so as to allow the ice tray 14 to be moved in the directions of and rotatively moved about the shafts 12 and 15.

Figure 7:
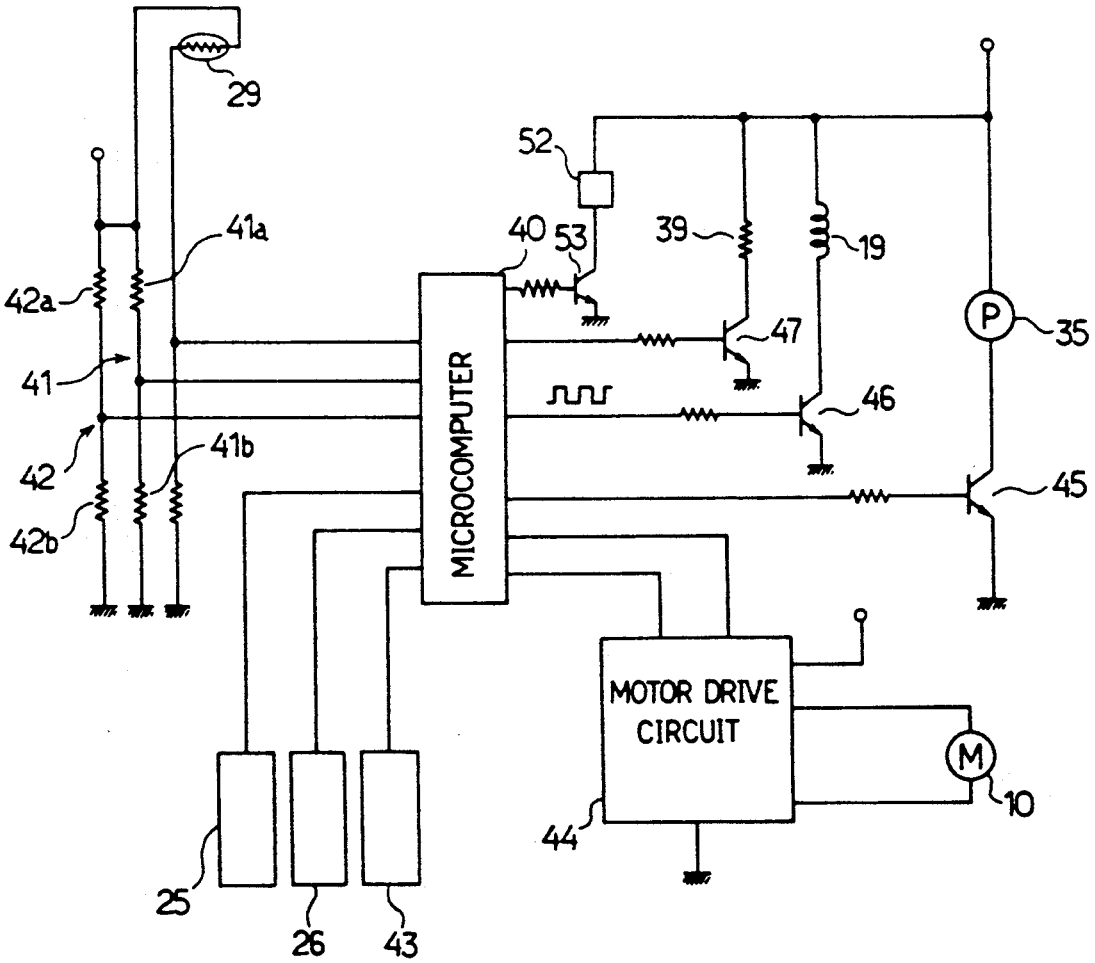
FIG. 7 is an electrical circuit diagram of the ice maker.

FIG. 7 shows an electric circuit for the abovedescribed automatic ice maker 7. A microcomputer 40 is provided for controlling stages of the ice making as will be described below. The microcomputer 40 is supplied with a voltage signal representative of the temperature of the ice tray 14 sensed by the thermistor 29, a first reference voltage generated by a first reference voltage generating circuit 41 so as to be representative of a water-supply completion temperature of the ice tray 14 (−9.5° C., for example), and a second reference voltage generated by a second reference voltage generating circuit 42 so as to be representative of an ice-making completion temperature of the ice tray 14 (−12.0° C., for example). The reference voltage generating circuit 41 comprises two resistances 41*a* and 41*b* series connected between a power-supply terminal and a ground terminal and similarly, the other reference voltage generating circuit 42 comprises two resistances 42*a* and 42*b* series connected between the power-supply terminal and a ground terminal. Detection signals are supplied to the microcomputer 40 from the horizontal position detecting switch 25, the inverted ice tray position detecting switch 26 and the reserved ice detecting switch 43 responsive to the reserved ice detecting lever 32. Furthermore, the motor 10 is connected to the microcomputer 40 through a motor drive circuit 44. The water supply pump 35, the electromagnet 19 and the heater 39 are also connected to the microcomputer 40 through transistors 45, 46, 47, respectively. The motor 10, the water supply pump 35, the electromagnet 19 and the heater 39 are controlled by the microcomputer 40 in the manner as will be described later.

Figure 8:
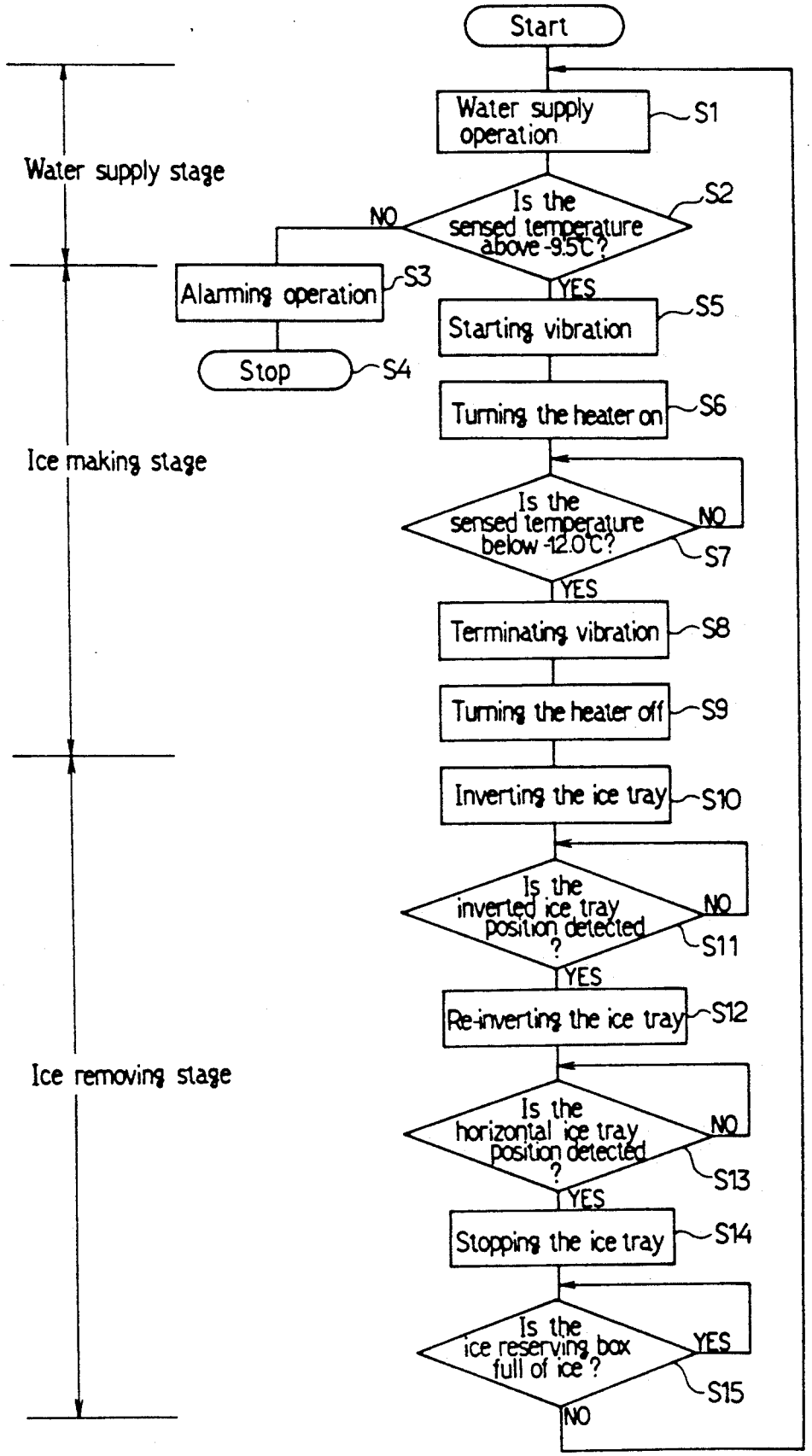
FIG. 8 is a flowchart explaining the control manner of a microcomputer.

The operation of the ice maker thus constructed will now be described with reference mainly to the flowchart of FIG. 8 showing the control manner of the microcomputer 40.

In a water supply stage, the water supply pump 35 is driven for a predetermined period of time through the transistor 45 at a step S1, thereby supplying water to the ice tray 14. At a step S2, the voltage signal representative of the temperature sensed by the thermistor 29 of the temperature sensor 28 is compared with the reference voltage from the first reference voltage generating circuit 41 so that it is determined whether or not the water supply has been completed. More specifically, when the temperature sensed by the temperature sensor 28 is lower than the water supply completion temperature (−9.5° C.), it is determined that the water has not been supplied to the ice tray 14 for the reason, for example, that no water is reserved in the water supply tank 34. In this case, an alarming operation is executed at a step S3 and the water supplying operation is interrupted at a step S4. On the other hand, when the temperature sensed by the temperature sensor 28 is higher than the water supply completion temperature, it is determined that the water supply has been completed and an ice making stage is initiated.

In the ice making stage, the microcomputer 40 delivers a voltage signal with a waveform as shown in FIG. 7, to the transistor 46 at a step S5. With this, the electromagnet 19 is controlled through the transistor 46 so as to be energized and deenergized and the ice tray 14 is vibrated in the directions of the shafts 12 and 15 or in the directions of the arrow A and opposite the arrow A by the vibration applying mechanism 18. At a step S6, the heater 39 is energized through the transistor 47. The chilled air from the outlet 37*a* is mainly directed to the lower portion of the ice tray 14 and the water is vibrated with vibration of the ice tray 14. Additionally, the water surface side is heated by the heater 39. Consequently, the ice making is retarded at the water surface side and the ice making is first initiated at the bottom side of the ice tray 14, progressing to the water surface side. As a result, air bubbles contained in the water may be caused to escape therefrom, thereby making transparent ice cubes.

The voltage signal representative of the temperature sensed by the thermistor 29 of the temperature sensor 28 is compared with the reference voltage from the second reference voltage generating circuit 42 for determination of the completion of the ice making stage, at a step S7 so that it is determined whether or not the ice making has been completed. It is determined that the ice making has been completed when the temperature sensed by the temperature sensor 28 is lower than the ice making completion temperature (−12.0° C.), thereby deenergizing the electromagnet 19 to thereby terminate application of the vibration to the ice tray 14 at a step S8. Then, the heater 39 is deenergized at a step S9 and the microcomputer 40 advances to an ice removing stage.

The motor 10 is energized through the motor drive circuit 44 to be rotated at a step S10 and consequently, the ice tray 14 is rotatively moved in the direction of the arrow B in FIG. 1 by the drive mechanism 13, thereby inverting the ice tray 14. When the convex portion 14*a* of the ice tray 14 is engaged with the support member 9, the ice tray 14 is twisted such that the ice cubes fall out into the ice reserving box 31, thus executing the ice removing stage. In this regard, the engaged portion 23 of the ice tray 14 is disengaged from the engaging portion 21*b* of the vibration transmission member 21 with the rotative movement of the ice tray 14. When the position of the inverted ice tray 14 is detected by the inverted ice tray position detecting switch 26 at a step S11, the microcomputer 40 advances to a step S12. The motor 10 is driven through the motor drive circuit 44 so as to be rotated in the direction opposite that in inverting the ice tray 14, thereby turning the ice tray 14 in the direction opposite the arrow B at the step S12. When the former horizontal position of the ice tray 14 is detected by the horizontal position detecting switch 25 at a step S13, the motor 10 is deenergized to terminate rotation of the ice tray 14, thereby returning the ice tray 14 to the former position, at a step S14. In this case, the engaged portion 23 of the ice tray 14 is reengaged with the engaging portion 21*b* of the vibration transmission member 21. At a step S15, it is determined by the reserved ice detecting switch 43 whether or not the ice reserving box 31 is filled full with the ice cubes. When it is determined that the ice reserving box 31 is not filled full with the ice, the microcomputer 40 returns to the step S1. When it is determined that the ice reserving box 31 is full of ice, the microcomputer 40 is on standby.

In accordance with the above-described embodiment, the ice tray 14 is vibrated by the vibration applying mechanism 18 in the ice making stage and accordingly, the ice making is retarded at the water surface side of the ice tray 14, with the result that the ice making is initiated at the bottom side of the ice tray 14. Consequently, the transparent ice cubes without air bubbles therein may be made.

The ice tray 14 is vibrated in the directions of the shafts 12 and 15 about which the ice tray 14 is rotatively moved. Consequently, the construction for vibrating the ice tray 14 may be simplified although it is inverted in the ice removing stage.

Since the electromagnet 19 is employed as the drive source of the vibration applying mechanism 18, the cost of the drive source may be reduced as compared with the cases where other drive sources are employed.

The engaging portion 21*b* is formed at the distal end of the plunger 20 of the electromagnet 19 and the engaged portion 23 is formed in the ice tray 14 so as to be disengageably engaged with the engaging portion 21*b*. The engaging portion 21*b* of the plunger 20 engages the engaged portion 23 of the ice tray 14 in the stage that the ice tray 14 is returned from the ice removing position to the ice making position. Furthermore, the engaging portion 21*b* disengages from the engaging portion 23 in the step that the ice tray 14 is inverted from the ice making position to the ice removing position. Thus, transmission of the vibration to the ice tray 14 and inversion thereof may be performed smoothly.

Furthermore, alarming means 52 is provided for alarming in the occurrence of the water supply failure. When the temperature sensed by the temperature sensor 28 at the time of completion of the water supply stage is below the predetermined temperature, the alarming means 52 is operated to alarm for the water supply failure. Consequently, the user can quickly find the occurrence of the water supply failure.

Furthermore, the position detecting switches 25, 26 are provided for detecting both of the horizontal and inversion positions of the ice tray 14, respectively. Based on the output signals from the position detecting switches 25, 26, the inverting operation of the ice tray 14 is stopped at the horizontal and inversion positions. Thus, the ice tray 14 may be stopped at each of the positions exactly and accordingly, the reliability of the inverting operation may be improved. Alternatively, instead of the position detecting switches 25, 26, the motor 10 of the drive mechanism 13 may be controlled by a timer so that the ice tray 14 is stopped at both of the horizontal and inversion positions.

The reserved ice detecting switch 43 is provided for detecting the ice cubes reserved in the ice reserving box 31 to thereby determine whether or not the ice reserving box 31 is filled full with the ice cubes. Since the ice making is interrupted while the ice reserving box 31 is filled full with the ice cubes. Consequently, an unnecessary amount of ice cubes can be prevented from being made and the ice cubes can be prevented from overflowing the ice reserving box 31.

The heat insulation cover 38 is provided so as to cover the upper side of the ice tray 14 during the ice making stage for preventing the chilled air from contacting the water surface in the ice tray 14. Consequently, the ice making at the water surface side may be retarded with more reliability.

The temperature sensor 28 is provided for sensing the temperature of the ice tray 14 and the microcomputer 40 is provided for determining the ice making completion time, based on the sensed temperature sensed by the temperature sensor 28 to thereby control the operations of the drive mechanism 13 and the vibration applying mechanism 18. Consequently, the ice making completion time is accurately determined and accordingly, a timely transition from the ice making stage to the ice removing stage ma be performed.

When the above-described automatic ice maker 7 is incorporated in household refrigerators, the transparent ice cubes may be made with ease at home.

The foregoing disclosure and drawings are merely illustrative of the principles of the present invention and are not to be interpreted in a limiting sense. The only limitation is to be determined from the scope of the appended claims.

I claim:

1. An ice maker comprising:

a) an ice making compartment;

b) an ice tray having a shaft, the ice tray being provided in the ice making compartment so as to be inverted about the shaft and slidable in the lengthwise direction of the shaft;

c) water supply means for supplying the ice tray with water;

d) chilled air supply means for supplying chilled air to the interior of the ice making compartment so that the water in the ice tray is converted to ice;

e) an electromagnet for vibrating the ice tray in the lengthwise direction of the shaft in an ice making operation so that air bubbles contained in the water in the ice tray are caused to promptly escape therefrom before the water frozen, thereby making transparent ice; and f) a drive mechanism for driving the ice, the drive mechanism inverting the ice tray, thereby removing the ice from the ice tray.

2. An ice maker according to claim 1, wherein the electromagnet has a plunger and an engaging portion formed in a distal end of the plunger, the ice tray has an engaged portion disengageably engaged with the engaging portion of the electromagnet, the engaging portion of the electromagnet engages the engaged portion of the ice tray while the ice tray is being re-inverted from an ice removing position to an ice making position, and the engaging portion of the electromagnet disengages from the engaged portion of the ice tray while the ice tray is being inverted from the ice making position to the ice removing position.

3. An ice maker according to claim 2, wherein the plunger of the electromagnet has a vibration transmission member fixed to the distal end thereof and the vibration transmission member has a distal end in which the engaging portion is formed.

4. An ice maker according to claim 1, which further comprises a cover covering the upper side of the ice tray during the ice making operation so as to prevent the chilled air from contacting the water surface in the ice tray.

5. An ice maker according to claim 1, which further comprises a heater applying heat to the upper side of the ice tray during the ice making stage.

6. An ice maker according to claim 5, which further comprises a cover covering the upper side of the ice tray during an ice making operation so as to prevent the chilled air from contacting the water surface in the ice tray, the heater being disposed inside the cover covering the ice tray.

7. A household refrigerator equipped with the ice maker in claim 1.

8. A method of making ice comprising the steps of:

a) supplying an ice tray with water;

b) feeding chilled air into an ice making compartment so that the water in the ice tray disposed in the ice making compartment, is frozen;

c) vibrating the ice tray with an electromagnet in the in the lengthwise direction of a shaft provided therein during an ice making operation so that air bubbles contained in the water in the ice tray are caused to escape therefrom before the water is frozen, thereby making transparent ice; and d) inverting the ice tray about the shaft after the ice is made, thereby removing the ice from the ice tray.

9. An ice maker comprising:

a) an ice making compartment;

b) an ice tray having a shaft, the ice tray being provided in the ice making compartment so as to be inverted about the shaft and slidable in the lengthwise direction of the shaft;

c) water supply means for supplying the ice tray with water;

d) chilled air supply means for supplying chilled air to the interior of the ice making compartment so that the water in the ice tray is converted to ice;

e) an electromagnet for vibrating the ice tray in the lengthwise direction of the shaft in an ice making operation so that air bubbles contained in the water in the ice tray are caused to promptly escape therefrom before the water frozen, thereby making transparent ice; and f) a drive mechanism for driving the ice tray after the water in the ice tray is made into the ice, the drive mechanism inverting the ice tray, thereby removing the ice from the ice tray.

g) a temperature sensor for sensing the temperature of the ice tray, the temperature sensor generating a signal representative of the sensed temperature;

h) position detecting means for detecting both horizontal and inversion positions of the ice tray, the position detecting means generating a signal when detecting each of the horizontal and inversion positions coupled by the ice tray; and i) control means for controlling the drive mechanism and electromagnet, the control means determining an ice making completion time based on the signal from the temperature sensor, thereby controlling the drive mechanism and the electromagnet, the control means activating the drive mechanism in accordance with the detection signals so that the ice tray is stopped at the horizontal and inversion positions.

10. An ice maker according to claim 1, which further comprises alarming means for alarming in occurrence of a water supply failure, the control means activating the alarming means when the temperature sensed by the temperature sensor at the end of a water supply operation by the water supply means is lower than a predetermined temperature.

11. An ice maker according to claim 1, which further comprises an ice reserving box for containing ice having fallen from the ice tray and reserved ice detecting means for detecting an amount of ice reserved in the ice reserving box, the control means interrupting an ice making operation while the reserved ice detecting means is determining that the ice reserving box is filled full with ice.

* * * * *